US005108690A

United States Patent [19]

Wolff

[11] Patent Number: 5,108,690

[45] Date of Patent: Apr. 28, 1992

[54] MAT FOR SUPPORTING A PERSON IN AN UPRIGHT POSITION AND PROCESS FOR OBTAINING A RESILIENT ARTICLE HAVING A STATIC MODULE WHICH IS STABLE OVER A LONG PERIOD

[75] Inventor: Per Wolff, Birkerod, Denmark

[73] Assignee: Cellastic A/S, Copenhagen, Denmark

[21] Appl. No.: 597,797

[22] Filed: Oct. 15, 1990

Related U.S. Application Data

[62] Division of Ser. No. 230,363, Aug. 10, 1988, abandoned.

[30] Foreign Application Priority Data

Aug. 14, 1987 [DK] Denmark ..... 4260/87

[51] Int. Cl.[5] ..... B29B 13/00

[52] U.S. Cl. ..... 264/345; 156/145; 264/230; 264/234; 264/235; 264/346

[58] Field of Search ..... 264/230, 234, 235, 345, 264/346; 156/145

[56] References Cited

U.S. PATENT DOCUMENTS

| | | | |
|---|---|---|---|
| 3,595,836 | 7/1971 | Korneli | 264/235 |
| 3,739,055 | 6/1973 | Ueda et al. | 264/235 |
| 4,247,514 | 1/1981 | Luise | 264/235 |

FOREIGN PATENT DOCUMENTS 0170947 12/1986 European Pat. Off. .

*Primary Examiner*—David A. Simmons
*Assistant Examiner*—Merrick Dixon
*Attorney, Agent, or Firm*—Watson, Cole, Grindle & Watson

[57] ABSTRACT

A process for providing a resilient mat having a plurality of adjacent interconnected liquid-filled compartments with walls made of an elastomeric material and which is stable over a long time period, wherein the mat is heated to a temperature above 50° C. until the liquid in the compartments has a pressure below 50% of it's initial pressure.

4 Claims, 1 Drawing Sheet

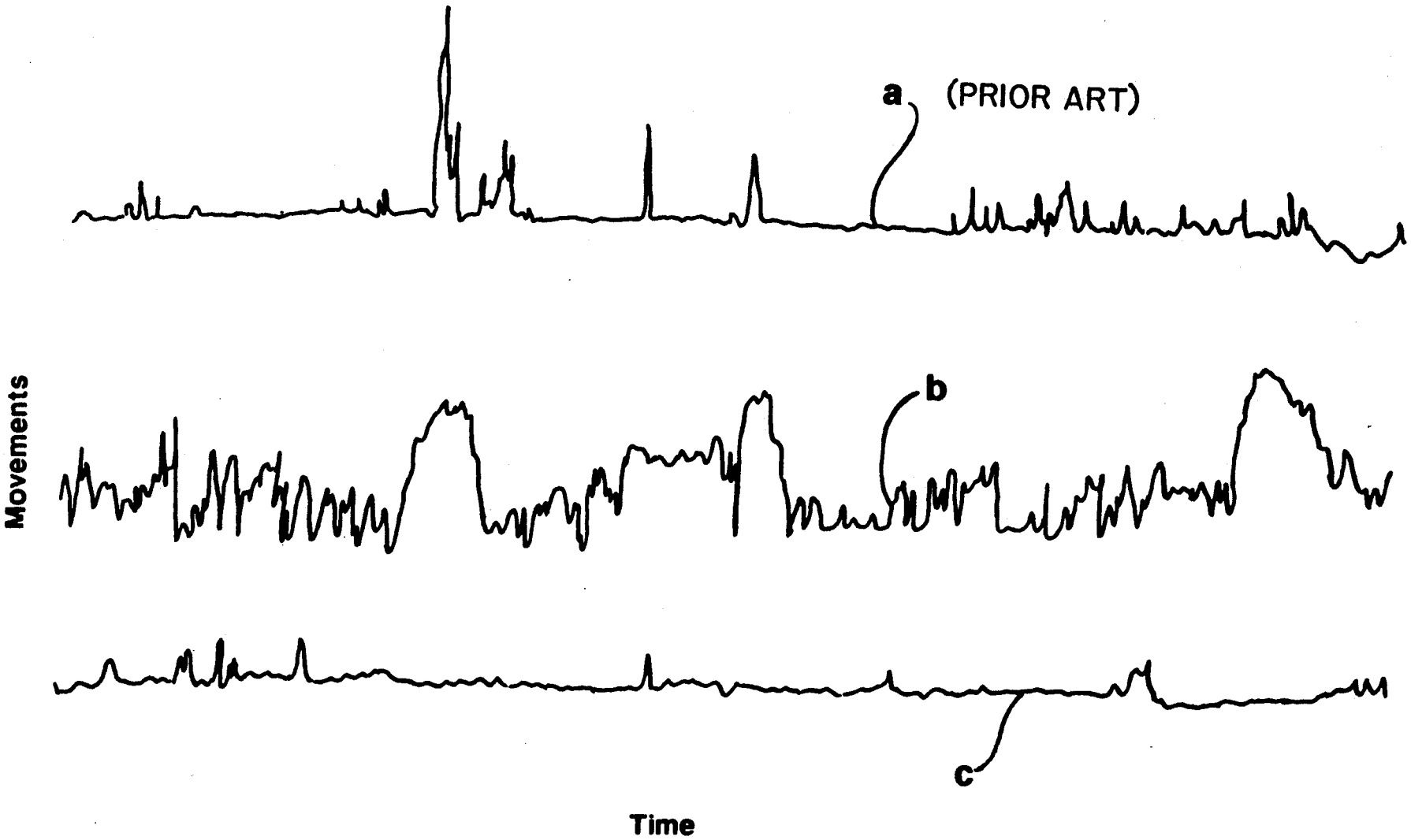
a
(PRIOR ART)
b
c
Movements
Time

MAT FOR SUPPORTING A PERSON IN AN UPRIGHT POSITION AND PROCESS FOR OBTAINING A RESILIENT ARTICLE HAVING A STATIC MODULE WHICH IS STABLE OVER A LONG PERIOD

This application is a divisional application of application Ser. No. 230,363, filed Aug. 10, 1988, now abandoned.

BACKGROUND OF THE INVENTION

This invention relates to a mat for supporting a person in an upright position comprising a number of adjacent interconnected liquid-filled compartments said compartments being dome shaped on at least one side of the mat and the dome-shaped compartment walls being mainly made from an elastomeric material.

A supporting device of the above type is disclosed in EP patent publication No. 0 170 947 A1.

Mats of the type described above have become popular for use in places of work where one stands up during work, e.g. persons tending machines and shop personnel, because said mats have proved to prevent tiredness in and swelling of the legs.

Experience has shown, however, that such mats slacken after a while with the result that one can "step through" the mats and that they are no longer comfortable to stand on.

In an attempt to eliminate this drawback and to achieve an increased degree of comfort for the users of said mats a closer analysis has been performed of the conditions determining whether the mats in question are comfortable to stand on or not.

During such analysis, it has been found that the reason why an erect person at work quickly experiences tiredness in his legs and suffers from swelling of his legs is that only relatively few muscle groups are activated and that, on the other hand, said muscle groups are strained for relatively long periods. This concurs with the seeming paradox that one feels more tired when standing completely still for a long time than when moving around, even though the latter presupposes higher energy consumption.

The actual reason why one by standing still rapidly feels tiredness in one's legs appears to be that the blood flow through the muscle tissue is reduced. Reversely, it is to be expected that if a person standing on a mat of the type in question is constantly forced to change position an activation of an increased number of muscle groups and thus an increased blood flow will be the result.

The result of changing positions will not only be important with respect to the leg muscles but also to foot joints, knee joints and hip joints which will also change position repeatedly.

Further investigations of the prior art mats have shown that the reason why they slacken so quickly is that the liquid pressure inside the mat decreases. This is more likely due to a change in the elastomeric material than to a loss of liquid by vaporization or leakage.

Attempts have been made to prevent the mats from slackening by increasing the pressure within the liquid-filled compartments to about 2.5 bar, which is substantially higher than the initial pressure in the prior art mats. Such a high pressure entails, however, that the mats feel too hard at the beginning which is unacceptable.

The pressures indicated herein are all pressures above atmospheric pressure.

Attempts have also been made to avoid a change in the elastomeric material by employing heat treated rubber plates in the production of said mats. This attempt has not met with the desired results because mats produced from such plates also slacken after a while.

Surprisingly it has been found, however, that if a pressure of 2.5 bar is established within the liquid compartments and the mat is subsequently subjected to heat treatment, a stable condition is achieved subsequent to an initial controlled change and the mat becomes resistant to long term changes. The heat treatment causes the pressure within the compartments to decrease to a suitable value sufficiently high to prevent "stepping through" but, on the other hand, not so high that the mat is felt hard to stand and walk on.

The change in the elastomeric material causing the prior art mats to slacken is presumably due to the fact that the tensile stress prevailing within the elasomeric material of the mat falls drastically in the course of time. The elastomer is subjected to a relaxation process. As to the prior art elastomers it has been found that the material relaxes with 10–15% per time decade, i.e. the relaxation—the fall in the tensile stress expressed in percentages—during the first 24 hours is the same as during the following 10 days and nights and during the next-following 100, etc.

The heat treatment of the liquid-filled mat, i.e. comprising an elastomeric material under heavy stress (as a consequence of a relatively high liquid pressure), apparently represents an accelerated relaxation and the relaxation cycle is hereby brought into a time decade wherein the relaxation per time unit is minor.

Apart from the fact that the internal pressure of the mat thus treated remains stable over the entire life time of the mat, it has acquired novel and useful properties especially as regards furthering the above mentioned muscle movements, which properties will be explained in the following.

Although the heat treated mats, as mentioned, are stable with respect to long term changes i.e. changes in the liquid pressure in the compartments, it has been found that a considerable relaxation of the material occurs in connection with the new loads being imposed on the material when a person steps onto the mat.

The load carrying capacity of the mat is a function of the liquid pressure within the compartments and the loaded area, and it is therefore to be expected a stable condition is achieved when a person stands with both legs on the mat. However, this is not the case because, as mentioned above, subsequent to the higher load a further relaxation is produced as evidenced by one's sinking down into the mat. Since the load ordinally is not the same from one leg to the other, one feel that one leg sinks lower than the other, and this generates a reflex induced correction in the attempt to change the load or to change one's position. More importantly, the same thing happens across the plane of the individual foot in case the heel or forefoot sinks.

These reflex conditioned changes result in the activation of other muscle groups and reduce, as explained above, the feeling of tiredness.

Such influences are normally of a relatively short duration and the subsequent relaxation is reversible. Despite the stabilisation of the material against long term relaxation, this allows for the material to undergo a desirable reversible relaxation of brief duration.

What is obtained is in other words controlled instability.

Furthermore, it has been found that a mat produced as explained above has a load carrying capacity which is 20-30% higher than that of a corresponding prior art mat. The term load carrying capacity means the force needed to achieve a given reduction of the height of the dome-shaped compartments over a support.

SUMMARY OF THE INVENTION

Thus it is a novel and characteristic feature of the mat according to the present invention that it exhibits a controlled instability, i.e. it works dynamically around a stable static condition. This is achieved by designing the mat so that the static tensile stress within the compartment walls, which is the result of their elongation generated by the liquid filling, is substantially lower than the tensile stress resulting from a corresponding dynamic elongation of the compartment walls and so that the pressure of the liquid-filled compartments is above 0.5 bar.

Preferably, the ratio of the former tensile stress to the latter is less than about 0.5.

The ratio of stress to elongation is essentially equal to the module of the material and the above discovery may thus be expressed as follows: The compartment wall exhibits a static module substantially lower than its dynamic module.

The static module is the module determined after very long relaxation periods when the stress in the rubber is almost exclusively due to the stretching of the rubber molecules via crosslinkages. This module is the one determining the static stress in the compartment wall and it generates and maintains the liquid pressure within the mat. The dynamic module is the module measured at short term loads. As mentioned, this module must be considerably higher than the static module which is achieved by rubber molecules not chemically crosslinked but only joined by temporary physical forces which contribute to support the load.

It has been found to be important that the elastomer meets certain requirements as regards the time-dependent elastic properties. The short term relaxation, i.e. the relaxation during the first couple of decades up to 100 minutes should be relatively high, e.g. 5-20% in order to obtain a higher degree of time-dependency with respect to the supporting function of the mat and to control the degree of desired instability.

The relaxation during the subsequent time decades must be lower and preferably within the range of from about 3% and about 10% because of the other utility properties.

The elastomer properties can be controlled by suitable choice of elastomer and compounding.

Examples of suitable elastomers are natural rubber, nitrile rubber, EPDM rubber, styrene butadiene rubber, chloroprene rubber and isoprene rubber.

It has been found that the elastomeric material used for obtaining the controlled instability should have an elasticity module at 300% elongation within the range of from about 50 to about 110 kp/cm$^2$. Elasticity modules lower than 50 kp/cm$^2$ requires too thick compartment walls to achieve a reasonable load carrying capacity. Most suitable modules have been found to be an E-module of 70+/−20 kp/cm$^2$ in connection with wall thicknesses within the range of from about 1.5 to about 3.5 mm. Even lower wall thicknesses can be employed in connection with a higher module but this increases the risk of puncturing the mat during use.

The ultimate tensile strength of the elastomer should be 150 kp/cm$^2$ at a minimum, preferably within the range above 200 kp/cm$^2$.

The internal pressure of the mat in combination with the geometry of the individual compartment determine the static load carrying capacity of the mat. This capacity can be illustrated with a curve showing the relationship between the resting load and the corresponding deformation, i.e. the compression of the compartment. In the event that the curve is determined on the basis of sufficiently long load periods the result is that the static load carrying capacity is directly proportional to the product of the supporting area and the liquid pressure within the mat.

The load carrying capacity is substantially higher for dynamic loads than for static ones. If a single compartment is suddenly loaded with a given load the compression will be relatively small at the beginning of the loading, but subsequently the compression increases. This is mainly due to an outflow of liquid from the loaded compartment.

By suitably combining of liquid viscosity and resistance of the flow passages leading away from the compartment this compression can be given a time factor within the range of ½ to a couple of seconds.

This effect is of importance as far as the shock absorbant function of the mat is concerned and it is based on the same principle as a liquid hydraulic shock absorber within the field of mechanics.

Our investigations have shown that mats according to the present invention exhibit the novel and surprising properties that during the subsequent period the deformation continues at a slower rate and that the deformation is no longer determined by the resistance to the outflow of the liquid, but is related to the relaxation of the heat treated rubber under the new load. The time factor for this deformation is within the range of from 10 to many hundreds of seconds. For instance, this effect causes a person stepping onto the mat to experience that the support slowly sinks slightly—is controlled instable—and the resulting reflex induced corrections of the weight distribution will further the vein pumping.

The invention also relates to a process of obtaining a resilient article comprising a number of adjacent interconnected liquid-filled compartments having compartment walls mainly made from an elastomeric material and having a static module which is static over a long period.

The process of the invention comprises subjecting the resilient article to a heat treatment at a temperature of above 50° C. for a period sufficiently long to reduce the liquid pressure within the compartments to a value below 50% of the initial pressure.

Preferably the heat treatment is effected at temperatures within the range of from 50° to 100° C. depending on the chosen elastomer. At temperatures higher than about 110° C. undesired phenomena in the form of boiling of the liquid and delamination of the article may occur. Below about 50° C. the effect of the heat treatment is insignificant. Experience has shown that temperatures within the range of from about 60° to 95° C. are suitable for treatment periods of between 120 and about 5 hours. Most preferably, the heat treatment is effected at 65°-85° C. for 24 to 8 hours. On the one hand, such treatment provides a static module which is stable over a long period, and on the other, it produces a suitable production cadence.

During the heat treatment the tensile stress in the elastomer surrounding the liquid-filled interior of the article is changed. This change can be observed by measuring the pressure in the liquid and the pressure change can be used to determine the length of the heat treatment necessary to obtain the desired decrease in the static module with a given elastomer. As an example, an article such as a mat is filled with so much liquid that the pressure immediately after the filling is above about 2.0 bar, e.g. 2.5–3.0 bar. At a suitable heat treatment at 72° C. and for 24 hours the pressure will fall to, e.g., about 0.85 bar. Generally, following the heat treatment the internal pressure of the mat should be below about 50% of the pressure at the time of the filling and in practice it should be within the range of 45% and 25% of the filling pressure for the mat described in the example below.

The dynamic module of the elastomer can be measured directly by measuring the elasticity module in a tensile strength test device. The static module cannot be measured in the same way because it is obtained only after constant deformation over a long period. Instead, a value which is proportional to the module can be obtained by measuring the liquid pressure in an article and determining the change in the liquid pressure obtained by quite small changes in the liquid volume. For mats of the type disclosed in the example it can be observed that for a number of mats filled with slightly varying volumes the pressure in the mats may vary with 1.3–1.7 millibar/ml liquid. After heat treatment the pressure variations caused by variations in liquid fillings have dropped to be within the range of 0.25–0.70 millibar/ml. Since the liquid volume determines the deformation—the elongation—of the elastomer and the liquid pressure is an function of the tensile stress in the mat walls, millibar/ml is an indication of the elasticity module of the elastomer, and as far as the heat treated mats are concerned their static module. However, an interesting and surprising fact is that the mats have maintained a high module towards dynamic influence irrespective of the heat treatment. This can be illustrated by taking a heat treated mat and injecting slightly more liquid into it. The pressure will then be found to have been increased by for instance 1.5 millibar/ml, exactly as it was the case with the original mat.

Although the present description primarily relates to the heat treatment of mats, it should be understood that the process of the invention is also suitable for the treatment of other liquid-filled articles such as carpet underlays, shoe soles, seats, matresses, handles, gloves, shock-absorbing materials, wound protecting materials, etc.

It appears from the description of the function of the mat that it is a characteristic property of the mat according to the present invention that there is a significant difference between the static and dynamic module of the mat. If the above mentioned relations between the internal pressure of the mat and the volume of injected liquid are taken as indications of the modules, the ratio of the dynamic module to the static module should preferably be higher than about 2 and preferrably within the range of 2.0–6.5 and most preferably within the range of 2.5 and 5.0.

Another characteristic property of the mat according to the present invention is that it is composed of interconnected liquid-filled compartments having elastomeric compartment walls which have been stabilised in the shape dilated by the liquid. This stability can subsequently be determined by subjecting the mat to a test wherein the pressure of the liquid prior to and after heating is measured. Test conditions are 72° C. for 12 hours. The pressure in the mat after correction for evaporization of liquid, if any, must not change more than 10% at most for mats according to the present invention, preferably 5% at a maximum.

The pressure in the mat after the heat treatment, the utility pressure, is consequently determined partly by the filling pressure partly by the pressure reduction resulting from the heat treatment. The utility pressure must be chosen so as to provide the necessary static load carrying capacity in combination with the geometry of the supporting compartments. It is a characteristic property of the mat that when subjected to static loads which are encountered in practice it cannot be completely compressed. The person must be carried by the liquid but at the same time the pressure must not be so high that the mat feels too hard, i.e. the deformation under load becomes too small to have any useful effect. The mat described in the example below will typically be felt to be too hard at pressures above 1.3 bar. As stated above it has been found that the heat treatment allows for higher static load carrying capacity, than was to be expected from the internal pressure and heat treated mats with pressures as low as to about 0,6 bar have proven to be very useful. Most preferable are pressures of 0.7–1.0 bar.

Since the supporting area is divided into individual compartments with non-supporting (not liquid-filled) areas between them the necessary utility pressure may deviate from the above-mentioned values provided that the mat is designed with another ratio of load carrying area to non-load carrying area.

As mentioned above, it has surprisingly been found that the heat treated mats may have a static load carrying capacity which is up to 30% higher than that of a corresponding non heat treated mat and having the same internal liquid pressure. No explanation has been found to this observation but the practical consequence thereof is that a given load carrying capacity and stepping-through resistance can be obtained with a lower pressure within the mats according to the present invention, viz. as low as 0.5 bar.

It is highly advantageous that the mats according to the present invention can be filled with very substantial amounts of liquid and hence with a given geometry of the base of each compartment it is possible to obtain a thicker mat without the pressure getting too high with the resulting inconveniences for the user.

DESCRIPTION OF PREFERRED EMBODIMENTS

In a preferred embodiment the mat consists of two elastomer sheets vulcanized together in a given pattern allowing the injection of liquid between the two sheets to cause the formation of a system of liquid-filled compartments interconnected by flow passages.

The desired pattern could for instance be obtained by applying a varnish to one of the two sheets prior to the vulcanization, which will then prevent the two rubber sheets from being bonded together in the areas that are to form the liquid-filled compartments and flow passages between them.

The pattern can also be achieved by placing a heat resistant sheet comprising holes obtained by punching and preventing lamination between the two non-vulcanized rubber sheets in the desired areas.

Another possibility for achieving the desired separations is to employ a double layer of a material which in itself will be bonded to the rubber, and wherein the separation takes place between the two single layers of the material in question. Such a material could for instance be paper.

Depending on the pattern of the masking used, mats can be produced with compartments having after filling circular, oval, oblong, or angular contours. The compartments may be interconnected either in one large circuit for the entire mat or in two or more individual closed circuits within the same mat. By employing two or more sub-systems within the same mat one may vary its properties over its surface so that, for instance, it has a harder central area supporting well at the beginning but where, on the other hand, the sinking at standstill is higher than in the surrounding softer part of the mat.

By using rubber sheets of different thicknesses the compartments will become largest on the side of the mat formed by the thinnest rubber sheet when the mat is filled with liquid. Thus it is possible to produce mats with a plane bottom surface and a top surface of dome-shaped compartments.

It is also possible to produce the mat so that only one side consists of an elastomeric material whereas the material on the other side is non-elastic. The non-elastic material may for instance comprise a fabric reinforced rubber or plastic material. Such an embodiment would be particularly preferable where the mat in use is exposed to heavy wear or unilaterally heavy loads or if it is to be fixed permanently to the place of use.

In a preferred embodiment the masking pattern used consists of interconnected circles with a diameter of 12–35 mm.

The mat is primarily used for the support of a person in an upright position. It may be designed as a mat intended to be placed on the floor in front of a working place and with the outer dimensions of the mat being adapted to the requirements for freedom of movement during work. It may be advantageous to divide a large mat into sections capable of being linked together. It will also be possible to subdivide a large mat so that the geometry or liquid pressure of the compartments vary from one section to the other. Thus it would for instance be possible to make the central area more instable to further the vene pumping whereas the remote parts are made more shock absorbant as regards walking for the purpose of fetching or delivering materials.

It is also possible and within the scope of the present invention to use the mats as support in or as part of a shoe giving particularly shock-absorbing effects in combination with controlled instability at standstill.

Measurement of the load carrying capacity of the mat can be made by compressing a single compartment in a well defined way and by measuring the force which during compression acts between the compartment and the piston compressing the compartment.

As mentioned above, it can be observed that initially the force is substantially above the static load carrying capacity of the mat. This is due to the fact that the rubber, which during heat treatment is stabilized in a stretched shape, the compartment walls now resist the new deformation. However, the force contribution of the rubber wall decreases in time because of the relaxation of the rubber and after a suitably long period the force will be relatively stable because the rubber adapts to the new shape and the liquid pressure becomes constant.

If the compartment is now unloaded and if a renewed measurement is performed shortly thereafter on the same compartment it will be found that the force necessary for compressing the compartment is substantially reduced. Typically, when effecting measurements within a period of 10–15 minutes it is found that the force is 10–15% lower. A similar hysteresis phenomenon is seen when drawing up a deformation/force curve at increasing deformation and immediately thereafter at decreasing deformation. At rates sufficiently low to eliminate the effect of the liquid flow the curves should largely overlap. However, it is a characteristic feature of the heat treated mats that the force curve at decreasing deformation is lower than at increasing deformation. The two curves form a so-called hysteresis loop.

EXAMPLE

A rubber mixture based on nitrile rubber is calendered to a rubber sheet of a thickness of 2.1 mm. Two pieces are cut out from the sheet and they are placed with one piece on top of the other and with a masking film placed inbetween. The masking film is made of a heat resistant material (polyester) that does not stick to the rubber during the subsequent vulcanization. The masking film is punched to form a pattern consisting of circles with a diameter of 20 mm interconnected with small strips.

The two sheets and the film between them are vulcanized in a press at about 170° C. for 20 minutes. This causes the two rubber sheets to fuse together in all the areas not masked with the film.

After vulcanization a syringe is inserted into the space formed by the film and a filler and a liquid injected in the space which consists of 80% glycerol in water thickened with carboxy methyl cellulose to obtain a viscosity of 200 cps at 20° C. The pressure inside the mat is observed during the injection and when it reaches 2.3 bar the injection is stopped, the syringe is removed and the inlet tube of the mat is sealed.

The top surface of the mat now comprises dome-shaped compartments of a base-diameter of about 2 cm in rows of each 24 compartments. In total the mat has 36 such rows and all compartments are connected to their neighbouring compartments by narrow flow passages formed by the small strips of the masking film. The aggregate liquid volume of the mat is 2,100 g and the height of the mat measured at the top of a compartment is 15.6 mm.

The mat is subsequently placed in a heater with circulating air at 72° C. for 24 hours. After cooling the edges are trimmed. The mat is then subjected to measurements with the following result: Comfort when standing up at work: High, no sinking through. Comfort when walking: Suitable, no stepping through. Liquid pressure in the mat: 0.8 bar. Load carrying capacity measured on a single compartment, 90% compression with a 2 cm piston, 2 minutes observation: 3,0 kp. Ratio of load carrying capacity after 15 sec to load carrying capacity at 120 sec: 1.15. Static module expressed as millibar/ml injected liquid: 0.3. Corresponding dynamic module: 1.4.

A mat as described above was compared with a mat of the type described in EP patent publication No. 0 170 947 A1 in the following test:

A lamp emitting a concentrated light beam was fixed to the instep of a foot of a test person standing on the mat to be tested in an upright position and reading a book. The lamp was fixed to the foot in such a manner that the light beam was parallel to the longitudinal axis of the foot and thus reflected movements of the instep in a vertical plane through the longitudinal axis of the foot.

The movements of the light beam were recorded on a moving chart placed in front of the test person.

The results obtained will appear from the drawing which illustrates the movements of the instep as a function of time.

Curves a and b illustrate the movements of a test person standing on the prior art mat and the mat according to the invention respectively whereas curve c illustrates the movements of a person standing directly on a concrete floor.

As will appear from the curves of the drawing, the mat of the invention causes a test person to change position repeatedly whereas he is standing essentially still over relatively long periods when he is standing on the prior art mat or on a concrete floor.

I claim:

1. A process for obtaining a resilient article comprising a number of adjacent interconnected liquid-filled compartments having compartment walls mainly made from an elastomeric material and having a static module which is stable over a long period characterized in heating the resilient article to a temperature of above 50° C. for a period sufficiently long to reduce the liquid pressure in the compartments to a value below 50% of the initial pressure.

2. A process according to claim 1, characterized in that the heating is carried through for a period sufficiently long to reduce the pressure to between 25 and 45% of the initial pressure.

3. A process according to claim 1, characterized in that the mat is heated to a temperature within the range of 60° and 95° C. for a period of 5 hours to 5 days and nights.

4. A process according to claim 3, characterized in that the mat is heated to a temperature within the range of 65° and 85° C. for a period of 8 to 24 hours.

* * * * *